United States Patent [19]

Freihage

[11] 4,312,322

[45] Jan. 26, 1982

[54] DISCED FRICTION HEATER

[76] Inventor: Robert P. Freihage, Box 416, Afton, Iowa 50830

[21] Appl. No.: 140,168

[22] Filed: Apr. 14, 1980

[51] Int. Cl.[3] ..... F24C 9/00

[52] U.S. Cl. ..... 126/247; 122/26

[58] Field of Search ..... 126/247; 122/26; 237/12.1; 165/89

[56] References Cited

U.S. PATENT DOCUMENTS

| | | | |
|---|---|---|---|
| 823,856 | 6/1906 | Gilroy . | |
| 1,366,455 | 1/1921 | Henson | 126/247 |
| 1,650,612 | 11/1927 | Denniston . | |
| 1,682,102 | 8/1928 | Allen . | |
| 2,344,075 | 3/1944 | Beldimano | 122/26 |
| 2,683,448 | 7/1954 | Smith . | |
| 3,164,147 | 1/1965 | Love . | |
| 3,333,771 | 8/1967 | Graham . | |
| 3,802,494 | 4/1974 | Bauch | 165/89 |
| 3,977,387 | 8/1976 | Lawler . | |
| 4,004,553 | 1/1977 | Strenstrom . | |
| 4,033,081 | 7/1977 | Perkins Jr. | 126/247 X |
| 4,143,639 | 3/1979 | Frenette . | |
| 4,271,790 | 6/1981 | Ahmed et al. | 122/26 |
| 4,273,075 | 6/1981 | Freihage | 126/247 X |

FOREIGN PATENT DOCUMENTS

| | | | |
|---|---|---|---|
| 371529 | 3/1923 | Fed. Rep. of Germany | 122/26 |

*Primary Examiner*—Samuel Scott
*Assistant Examiner*—Randall L. Green
*Attorney, Agent, or Firm*—Henderson & Sturm

[57] ABSTRACT

A heating device has a drive shaft rotated by a motor; the drive shaft is supported by bearings at its ends and has an upstanding key portion running substantially along its length; spacer elements and disc members having mating keyways aligned with the upstanding key of the shaft are alternatively positioned on the shaft between the bearings; a shell member, comprised of two complementary mating sections, encloses the rotating shaft/spacer/disc assembly, allowing for a space between its inside surface and the disc and spacer members; oil is circulated from a reservoir through feeder lines into the shell member to occupy the space, the oil being retained in the shell by an oil seal at the driving end of the shaft and an end plate at the driven end of the shaft; the spinning discs heat the oil, with the oil transferring heat to the shell; the exterior of the shell has adjacent disc sections defining air spaces where the heat radiated from the shell is most intense; the shell is enclosed in an insulated housing and a fan directs an air flow into the housing proximate to the shell molding and upward through the air spaces to carry away the heat.

15 Claims, 8 Drawing Figures

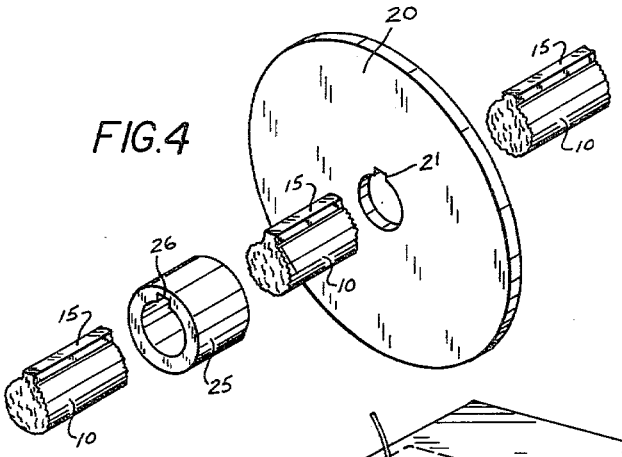
FIG.4
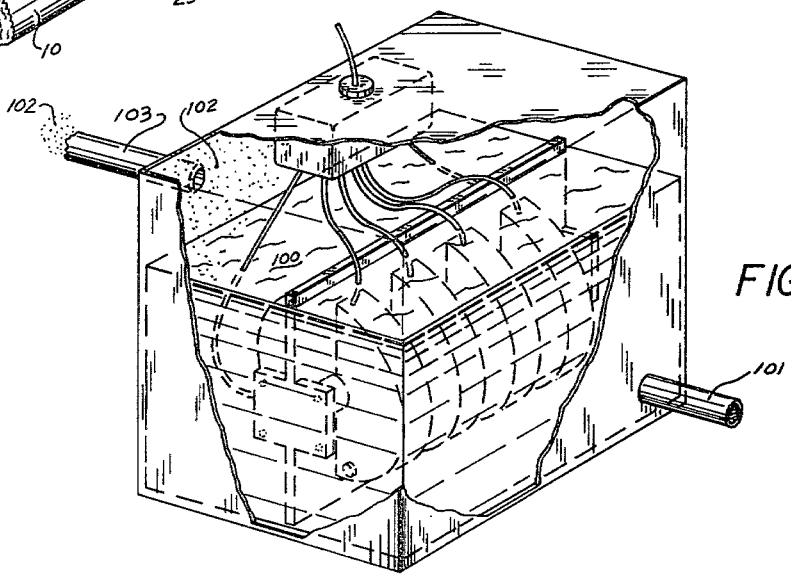
FIG.5
FIG.6
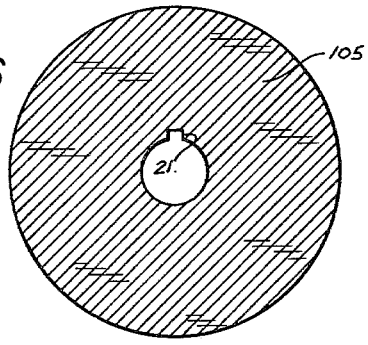
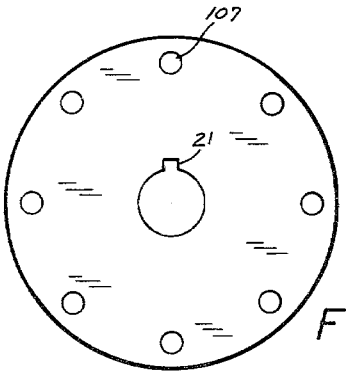
FIG.7
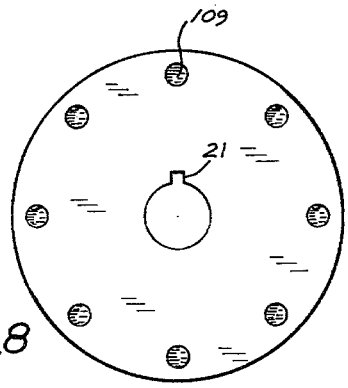
FIG.8

DISCED FRICTION HEATER

BACKGROUND OF THE INVENTION

The present invention pertains to the field of heating devices, and more particularly, to frictional heating devices.

The state of the prior art in this field is principally disclosed in U.S. Pat. No. 4,143,639 which shows a frictional heating device which employs telescoping cylinders; the outer one stationary and the inner one rotationally mounted on a drive shaft; with a quantity of oil dispersed between the cylinders to provide an interface and to transfer heat. Other less pertinent prior art is shown in U.S. Pat. Nos. 4,044,553; 3,997,387; 3,333,771; and 2,683,448.

The present invention is a marked improvement over U.S. Pat. No. 4,143,639 due to the utilization of spinning discs in a conforming shell molding which provide for a greater heater surface area, and consequently, a higher efficiency in heating output in relation to electrical energy input. The applicant has found that his invention, as hereinafter disclosed, is a very efficient and economical means of generating heat for space heating, and other purposes. The invention disclosed is, of course, especially in demand due to skyrocketing energy costs and the growing scarcity of resources.

SUMMARY OF THE INVENTION

The present heating device invention comprises a plurality of discs secured to a rotating drive shaft and enclosed by a stationary shell molding. The shell is suitably dimensioned to allow for a clearance, or space, between its interior surface and the spinning discs. The space is filled with oil which becomes heated due to the action of the spinning discs. The heat from the oil is absorbed by the shell member and conveyed to its exterior surface where it is carried off by a forced air flow.

The utilization of a disc structure, rather than a cylindrical structure, enhances heating efficiency by providing a greater heated surface area in contact with the air flow. Input energy efficiency in relation to heat output is substantially increased.

The present invention, in addition, employs an oil circulation system which circulates the heated oil from an oil reservoir to the shell molding; and within the shell molding, circulates the oil through the bearings supporting the shaft/spacer/disc assembly. The circulation of oil through the bearings provides for liberal lubrication of the spinning elements which further promotes the efficiency of the instant structure.

It is, therefore, an object of the present invention to provide a highly efficient frictional heating device wherein heat is radiated from a maximized heat exchanger surface area.

It is a further object of the present invention to utilize spinning discs enclosed by a conforming shell to provide for maximized heat exchanger surface area.

Another object of the present invention is to employ an oil circulation system wherein the oil serving as a heat transfer medium is circulated through the bearings supporting the spinning elements to liberally, and simply, lubricate the same.

Still another object of the present invention is the employment of dual centrifugal fans each of which independently cool a mating ½ section of the shell member.

These and other objects, advantages and novel features of the invention will become apparent from the following detailed description of the invention taken in conjunction with the accompanying drawings.

BRIEF DESCRIPTION OF THE DRAWINGS

FIG. 4 is a partial perspective view showing the mating key/keyway assembly of the discs and spacers to the shaft.

FIG. 5 is a partial perspective view of an alternate embodiment of the present invention.

FIG. 6 shows an elevational view of an alternate embodiment of a disc.

FIG. 7 shows an elevational view of an alternate embodiment of a disc.

FIG. 8 shows an elevational view of an alternate embodiment of a disc.

DESCRIPTION OF THE PREFERRED EMBODIMENT

Figure 1:
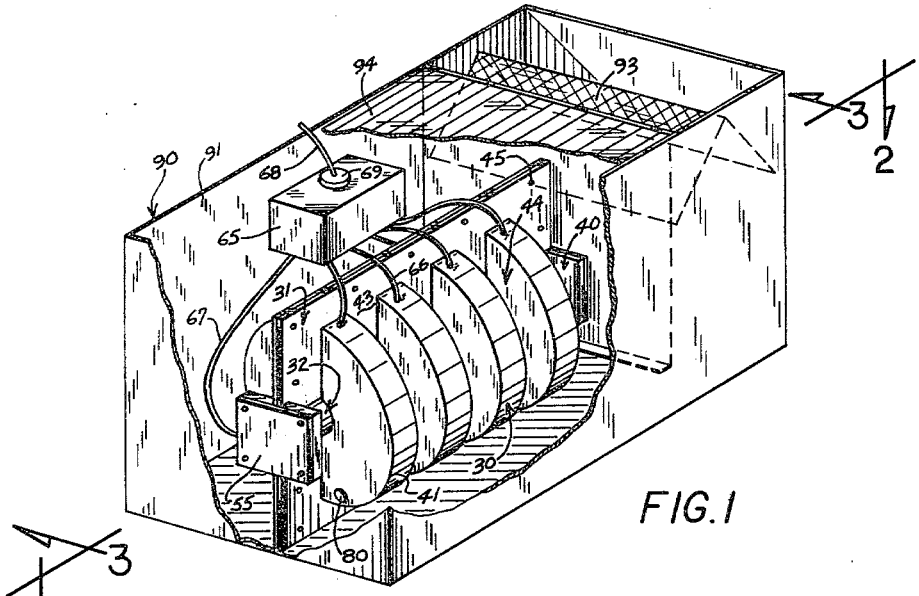
FIG. 1 is a perspective view of the present invention with portions of the housing broken away for clarity.
Figure 2:
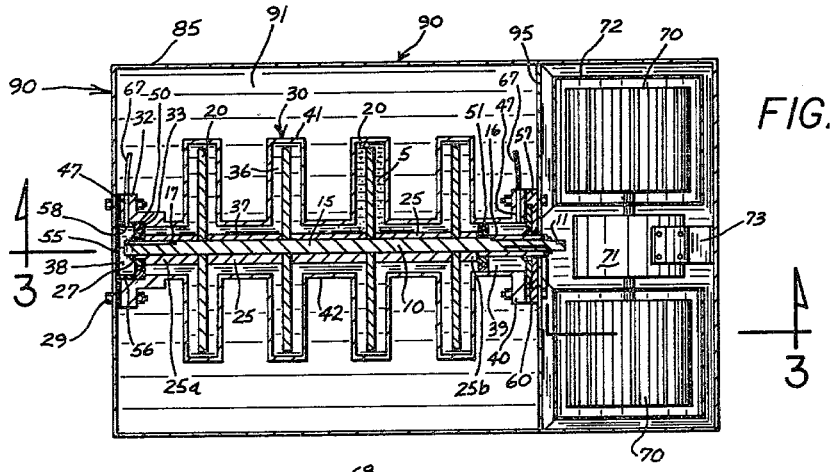
FIG. 2 is a cross-sectional plan view of the present invention taken along line 2—2 of FIGS. 1 and 3.
Figure 3:
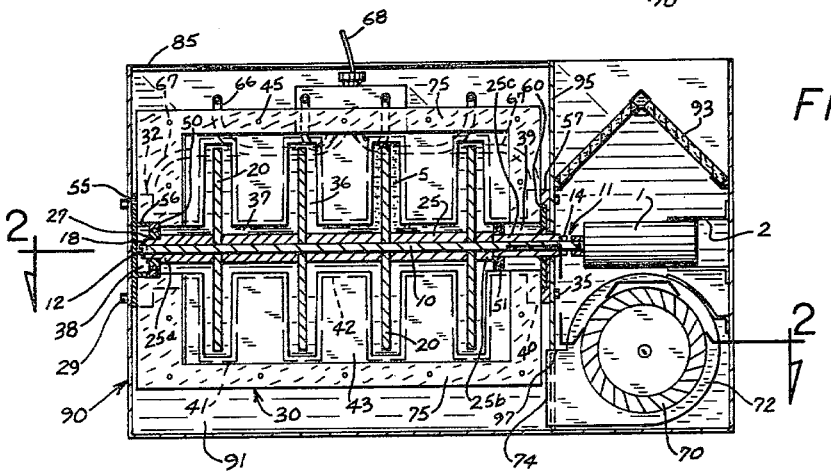
FIG. 3 is a cross-sectional elevational view of the invention taken along line 3—3 of FIGS. 1 and 2.

With reference to FIGS. 1-3, the present invention, in brief overview, comprises a drive shaft motor 1 which rotates a shaft 10 to which discs 20, separated by spacers 25, are rigidly affixed; the rotating shaft/-spacer/disc assembly is enclosed within a shell member 30 which allows for internal oil spaces 36, 37, 38,39. A quantity of oil 5 circulates within the oil spaces 36, 37, 38, 39, to transfer frictionally generated heat to the shell member 30. Shell 30 is enclosed within a housing 90 such that an air flow induced by fan 70, flowing proximate to the heated shell member 30, carries heat into an enclosure for space heating purposes.

Describing the invention in detail, and with particular reference to FIGS. 2 and 3, drive member 10 is coupled to the power source 1 at its driving end 11 such that the drive shaft 10 is rotatable at high speed by the motor 1. Driven end 12 is opposite to driving end 11 on shaft 10. FIG. 4 shows the assembly of the spacers 25 and discs 20 to the shaft 10. The key 15 of shaft 10 is inserted into the keyway 26 of spacer 25 and into the keyway 21 of disc 20 so that the shaft 10, spacer 25 and disc 20 are secured for rotational movement and compromise a shaft/spacer/disc assembly which rotates as a unit. FIG. 2 shows key 15 of the shaft 10 extending along the central region of shaft 10 and terminating at shoulder portions 16 and 17.

FIGS. 2 and 3 illustrate the assembly of the spacers 25 and discs 20 to the shaft 10. Beginning with the driven end 12 of shaft 10, a driven end spacer 25*a* is first installed upon the shaft 10 with its keyway accommodating the end portion of key 15 terminating in shoulder 17. Moving to the right with reference to FIGS. 2 and 3, a disc 20 is next installed upon shaft 10 followed by a spacer 25. Three more discs 20 are then installed alternatively with two more spacers 25. Next a shortened spacer 25*b* is installed followed by driving end spacer 25*c* to complete the shaft/spacer/disc assembly. The keyway of driving end spacer 25*c* accommodates the end portion of key 15 of the shaft 10 terminating at shoulder 16.

With reference to FIG. 3 the driven end 12 of shaft 10 extends somewhat outwardly (or to the left) from driven end spacer 25*a*, and is provided with a first snap ring 18 which abuts with the end of spacer 25*a*. Driving end 11 includes a threaded portion (not shown) extending outwardly (or to the right) from driving end spacer 25*c* to threadably engage nut 14. Nut 14 is threadably turned upon shaft 10 until it firmly abuts with spacer 26*c*. In this way the discs 20 and spacers 25 are secured upon the shaft against longitudinal movement between nut 14 and first snap ring 18.

The shaft/spacer/disc assembly, thus described, is mounted upon bearings 50 and 51 for rotational movement. Bearings 50 and 51 are mounted within suitable recesses in the shell member 30.

Shell member 30 is comprised of mating sections 31 which are assembled over the shaft/spacer/disc assembly. FIGS. 1–3 show first end plate 55 installed at the left end of shell member 30 in FIGS. 2 and 3. First end plate 55 seals the left end of the shell member 30 and includes a protruding collar 56 centrally disposed from its inside surface. Collar 56 is received within the cyllindrical interior region of end section 32 of the shell 30 as shown in FIGS. 2 and 3. Collar 56 abuts with bearing 50 to secure the bearing 50 against the inside shoulder portion 33 of end section 32.

Driven end spacer 25*a* is supported by bearing 50 and extends slightly outwardly (or to the left) from the bearing 50. A second snap ring 27 is secured upon spacer 25*a* to abut with the bearing 50.

Bolts 29 inserted through the housing 90, first end plate 55, and the end section 32 of shell member 30 secure the shell member 30 to the housing 90 and ensure that end plate 55 seals the left end of the shell member 30.

The driving end of the shaft/spacer/disc assembly is supported by bearing 51 which is supported within a suitable recess in the interior of end section 40 of the shell member 30. Bearing 51 abuts spacer 25*b* and supports spacer 25*c* for rotational movement.

Spacer 25*c* extends through an oil seal 60 and a second end plate 57. Second end plate 57 has a suitable centrally disposed aperture to accommodate spacer 26*c*. Second end plate 57 also includes a suitable circular recess, or depression, to accommodate oil seal 60 as shown in FIGS. 2 and 3. The housing 90 has a partition wall 95 and bolts 35 are installed through partition wall 95, second end plate 57 and into end section 40 to secure shell member 30 to housing 90, and to secure second end plate 57 holding oil seal 60 upon spacer 26*c*.

Shell member 30 is comprised of complementary mating sections 31 which are assembled together by bolts 45 to enclose the shaft/spacer/disc assembly. Shell member 30 is secured at its ends to the housing 90 by suitable bolts as described above.

Each of the mating sections 31 has end sections 32, 40, a base member 43, and a plurality of disc sections 41 separated by spacer sections 42. The disc sections 41 are disposed substantially normally from the base members 43, the disc sections 41 having a slight narrowing taper towards their periphery to facilitate withdrawal of the sections 31 during the casting operation presently employed.

Mating sections 31 are assembled together by bolts 45 to enclose the entire shaft/spacer/disc assembly except for the driving end 11 of the shaft 10 which is coupled to the motor 1 as shown in FIG. 3. Shell 30 is suitably dimensioned in its interior regions to allow a clearance, or space, between the discs 20 and spacers 25 and the interior surface of shell 30, thereby creating disc oil spaces 36 and spacer oil spaces 37. Note that the end sections 32, 40 provide for end oil spaces 38, 39. Oil space 38 lies between first end plate 55 and bearing 50, while oil space 39 lies between spacer 25*c* and the inside surface of end section 40. With reference to FIG. 1, note also that the spaced disc sections 41 define air spaces 44 along the exterior surface of shell 30. Shell 30 is secured to the housing 90 within the heater compartment 91 of housing 40.

Housing 90 is comprised of the heater compartment 91 and intake shaft 92, divided by partition wall 95. Partition wall 95 supports one end of the shell member 30, as shown, and includes air intake openings 97 at its lower end.

A pair of centrifugal fans 70, driven by a fan motor 71, and enclosed by fan housings 72 are secured within the air intake shaft 92 by means of a suitable bracket 73. The motor 1 is also secured within the air intake shaft by means of a suitable bracket 2. At the inlet portion of the air intake shaft 92 a filtering means 93 is provided. Fans 70 have discharge outlets 74 which conform to the intake openings 97 of partition wall 95 to provide for fluid communication between the intake air shaft 92 and the heater compartment 91.

Heater compartment 91 includes an overlying damper means 94, and has an oil reservoir 65 secured to an inside wall above shell member 30 as shown in FIGS. 1 and 3.

Oil reservoir 65 holds a supply of oil and has circulation tubes 66, 67 which permit oil to circulate between the reservoir 65 and the oil spaces 36, 37 of shell member 30; and also between the reservoir 65 and the oil spaces 38, 39 of the end sections 32, 40 in a manner next described.

FIG. 1 shows four disc feeder tubes 66 providing for oil circulation between the reservoir 65 and disc sections 41 of shell member 30. FIGS. 1–3 show two bearing feeder tubes 67, one leading to each of the end sections 32, 40 of the shell member 30. Each of the end sections 32, 40 of shell member 30, has an oil channel 47 which permits fluid communication between the bearing feeder tubes 67 and the end oil spaces 38, 39. First end plate 55 includes an aperture 58 in collar 56 which is aligned with oil channel 47 to permit the unobstructed flow of oil from channel 47 into end oil space 38.

The bearings 50, 51 permit oil to circulate between the end oil spaces 38, 39 and the spacer oil spaces 37. Consequently, a continuous and complete circuit of fluid communication is provided from reservoir 65 through feeder lines 66 to disc oil space 36, which in turn communicate with spacer oil spaces 37, then from spacer oil spaces 37 through bearings 50, 51 to end oil spaces 38, 39 and finally from end oil spaces 38, 39 through oil channels 47 and into feeder lines 67 back to the reservoir 65. Reservoir 65 also includes a vent line 68 to carry odors from the heated oil to an ambient point. A filler cap 69 is provided to fill the reservoir 65 and shell member 30 with oil as necessary. A drain outlet, being sealable by a drain plug 80, is provided at a low point on shell member 30 to permit drainage of the oil. A porous gasket 75 is secured between the shell members 31 around their periphery as shown in FIG. 3. The gasket 75 seals the oil within shell member 30 while permitting the oil to drain to the bottom of the shell member 30 where it can be removed via the drain outlet.

In operation, the invention functions as follows:

The shell member 30 is filled with a predetermined quantitiy of oil via the feeder lines 66, 67 and the reservoir 65. The motor 1 then is activated to rotate the shaft/spacer/disc assembly at a desired speed. As the assembly spins, the oil lying within the oil spaces 36, 37 is frictionally heated due to the relative movement between the rotating discs 20 and the interior surface of the stationary shell member 30. As the oil becomes heated it expands to fill the entire interior region of the shell molding comprised of the oil spaces 36, 37, 38, 39. The oil circulates between the oil spaces 36, 37, 38, 39 and the reservoir 65 through the feeder lines 66, 67. The circulation of oil through the bearings 50, 51 as aforedescribed liberally lubricates bearings 50, 51 whereby the unimpaired rotation of the assembly is facilitated contributing to the efficiency of the present invention.

The heat of the oil 5 is absorbed by the interior surface of the shell 30 and conveyed through the shell 30 to its exterior surface whereby the exterior surface of the shell 30 is brought to a heated state. The heat radiated by the shell 30 is most intense in the vertically oriented air spaces 44 defined by the oppositely disposed walls of the disc sections 41 of the shell molding 30. See FIG. 1.

Once the shell member 30 achieves operating temperature, the fan 70 is activated to utilize the heat generated for space heating purposes. The dual centrifugal fans 70 draw an intake air flow through the air filtering means 93 and down the air intake shaft 92. This air flow is drawn in through the diametrically opposed ends of each of the fans 70 and is discharged radially from fans 70 into the fan housings 72 which direct the ejected air flow through the discharge outlets 74 of the fans 70 and into the heater compartment 91 through the air intake openings 97. Note that the air flow drawn down the air intake shaft must circumvent both the drive shaft motor 1 and the fan motor 71, and consequently, the waste heat from these motors is utilized to preheat the air flow. There are two streams of ejected air flow entering the bottom of the heater compartment 91; one from each of the fans 70. These two air streams turn upward and split the shell molding 30, one air stream traveling up through the vertically, intensly hot air spaces 44 on each side of the shell member 30. Thus, each fan 70 cools one of the complementary mating sections 31 of the shell member 30.

The air flow through the air spaces and proximate to the shell member 30, generally, absorbs heat from the shell 30 which is carried upward through the damper 94 and into a room for space heating purposes. The housing 40 can be surrounded by an insulating material 85 to increase efficiency.

It can, thus, be appreciated that the present invention is suitable for generating heat which can be applied for space heating purposes and for other purposes as will be described below.

The following specifications have also been found to achieve the purposes of the invention. The discs 20 emloyed have been $\frac{1}{8}''$ in thickness. The disc oil spaces 36 are generally about $\frac{1}{8}''$ wide, however, it is believed that a range of up to $\frac{1}{2}''$ could be used. The air spaces 39 are generally about $\frac{1}{2}''$–$1''$ in width.

The invention is, of course, not intended to be limited by the above dimensions; it being understood that obvious variations are included within the invention.

Inasmuch as the present invention is a means for generating heat, the heat generated could be applied to various purposes and is not to be limited to the heating of an air flow. For example, the shell molding 30 could be immersed in water and thereby used to generate steam as shown in FIG. 5 where water 100 enters via inlet pipe 101 and becomes steam 102 which is removed via outlet pipe 103. The steam generated could be applied in a floor board steam heater, or to turn a steam generator, for example. Other applications of the heat generated could also be made.

The discs 20 disclosed, thus far, have been generally smooth in surface texture. The applicant has found that while smooth surface discs are suitable, the disc surfaces can be modified with improved results. The discs can be given a rough surface 105 to increase friction as shown in FIG. 6. The discs can also be provided with peripherally disposed apertures 107 as shown in FIG. 7 to decrease the oil pressure at the disc periphery, and thereby, reduce drag. The applicant has furthermore found that providing a disc with apertures 109 extending only a part of the way through the disc as shown in FIG. 8 significantly increases the heat generated by the device.

Having, thus, disclosed the present invention, it is intended to be appreciated that obvious modifications or variations could be made which would be within the applicant's teachings, and the spirit of the invention disclosed. It is, therefore, to be understood that, within the scope of the appended claims, the invention may be practiced otherwise than as specifically described.

I claim:

1. A heating device having a power source, comprising:

(a) a drive member rotated by said power source;

(b) a plurality of discs secured to said drive member; said discs being rotated by said drive member;

(c) a shell member enclosing said discs, said shell member having a base member and a plurality of disc sections disposed substantially normally from said base member, each of said disc sections enclosing a portion of one of said discs, said disc sections being adjacently spaced along said base member to define an air space between each adjacent pair of disc sections, said shell member being stationary and each of said disc sections having an interior surface and an exterior surface, said shell member providing for disc oil spaces between said interior surfaces of said disc sections and said discs; and (d) oil circulating within said disc oil spaces between said rotating discs and said disc sections of said stationary shell member whereby said oil becomes heated due to friction, said heated oil transferring heat to said shell member such that said exterior surface of said disc sections of said shell member becomes heated.

2. The heating device of claim 1, wherein said shell member is comprised of a pair of complementary mating sections.

3. The heating device of claim 2 further comprising one or more spacer members, said spacer members being disposed along said drive member on opposite sides of each of said discs such that said spacer members alternate with discs along said drive member.

4. The heating device of claim 3 wherein said drive member is a shaft having a key, said discs having mating keyways, and said spacers having mating keyways, said mating keyways of said discs being aligned with said key of said shaft to secure said discs rotationally with said shaft, said mating keyways of said spacers being aligned with said key of said shaft to secure said spacers rotationally with said shaft whereby said shaft, said discs, and said spacers are rotated as a unit by said power source.

5. The heating device of claim 4 wherein said disc oil spaces are approximately $\frac{1}{8}$ inch in width.

6. The heating device of claim 4 further comprising an oil reservoir and wherein said shaft has two ends, and said shell member has a pair of end sections, said shaft being supported at each of said ends by a bearing, each of said bearings being spaced inwardly along said shaft from an end oil space provided within each of said end sections, said end oil spaces having fluid communication with said oil reservoir, said end oil spaces having fluid communication with said disc oil spaces through said bearings, said disc oil spaces having fluid communication with said oil reservoir; such that said oil circulates between said reservoir and said end oil spaces, between said end oil spaces and said disc oil spaces through said bearings, and between said disc oil spaces and said reservoir.

7. The heating device of claim 6 wherein said shell member includes a plurality of spacer oil spaces, said oil circulating between said end oil spaces and said spacer oil spaces through said bearings, said oil circulating between said spacer oil spaces and said disc oil spaces.

8. The heating device of claim 2 further comprising a fan in fluid communication with said air spaces, said base members of said mating half sections of said shell member being vertically oriented such that said air spaces comprise vertical air passages, said fan expelling an air flow in a vertically upward direction through said vertical air passages.

9. The heating device of claim 8 wherein said air spaces are $\frac{1}{2}''$ to $1''$ in width.

10. The heating device of claim 2 further comprising an oil reservoir in fluid communication with said disc oil spaces, said oil circulating between said disc oil spaces and said oil reservoir, said oil reservoir having an exhaust line leading to an ambient exhaust outlet such that said oil reservoir is vented and expels odors through said ambient exhaust outlet.

11. The heating device of claim 2 further comprising an insulated housing enclosing said shell member within a heater compartment, said housing including an air intake shaft, a fan being disposed within said air intake shaft, a partition wall substantially separating said heater compartment from said air intake shaft, said partition wall including an air inlet opening providing for fluid communication between said heater compartment and said air intake shaft; said fan drawing air down said air intake shaft and expelling an air stream through said air inlet opening such that said air stream circulates through said heater compartment proximate said shell molding.

12. The heating device of claim 2 wherein said discs have a rough exterior surface.

13. The heating device of claim 2 wherein said discs include peripherally disposed apertures.

14. The heating device of claim 2 wherein said discs include apertures extending partially through said discs.

15. The heating device of claim 2 wherein said shell member is immersed in an enclosed volume of water to generate steam.

* * * * *